US006262353B1

(12) United States Patent
Murray

(10) Patent No.: US 6,262,353 B1
(45) Date of Patent: Jul. 17, 2001

(54) STRINGED INSTRUMENT WITH IMPROVED NECK AND BODY ATTACHMENT

(76) Inventor: Patrick Murray, 302 S. Rolling Rd., Catonsville, MD (US) 21228

( * ) Notice: Subject to any disclaimer, the term of this patent is extended or adjusted under 35 U.S.C. 154(b) by 0 days.

(21) Appl. No.: 09/465,927

(22) Filed: Dec. 17, 1999

(51) Int. Cl.[7] ..... G10D 3/00
(52) U.S. Cl. ..... 84/290; 84/291; 84/293
(58) Field of Search ..... 84/292, 718, 293, 84/743, 290, 291

(56) References Cited

U.S. PATENT DOCUMENTS

| | | | | |
|---|---|---|---|---|
| D. 400,563 | | 11/1998 | Jones | 17/20 |
| 3,657,462 | | 4/1972 | Robinson | 84/1.16 |
| 4,073,211 | | 2/1978 | Jorgensen | 84/291 |
| 4,126,073 | | 11/1978 | Takabayashi | 84/293 |
| 4,172,405 | | 10/1979 | Kaman, II | 84/293 |
| 4,295,403 | | 10/1981 | Harris | 84/293 |
| 4,377,962 | | 3/1983 | Parker | 84/269 |
| 4,432,267 | * | 2/1984 | Feller | 84/293 |
| 4,803,906 | * | 2/1989 | Fender | 84/293 |
| 4,939,970 | * | 7/1990 | Hoshino et al. | 84/293 |
| 5,347,904 | * | 9/1994 | Lawrence | 84/291 |
| 5,353,672 | * | 10/1994 | Stewart | 84/291 |
| 5,452,637 | * | 9/1995 | DeCola | 84/291 |
| 5,661,252 | | 8/1997 | Krawczak | 84/291 |
| 5,973,242 | * | 10/1999 | Spezia | 84/290 |
| 6,025,548 | * | 2/2000 | Ehrich | 84/291 |
| 6,028,255 | * | 2/2000 | Myronyk | 84/293 |
| 6,051,766 | * | 4/2000 | Taylor | 84/293 |

* cited by examiner

*Primary Examiner*—Robert E. Nappi
*Assistant Examiner*—Kim Lockett
(74) *Attorney, Agent, or Firm*—Hogan & Hartson; Celine Jimenez Crowson

(57) ABSTRACT

A stringed musical instrument, preferably an electric guitar, is made with separate neck and body portions. The neck and body portions are connected together via screws, bolts or the like that are preferably located underneath a cover plate on the front side of the instrument. The cover plate is most preferably a sound pick-up that is located within a pick-up cavity. The instrument includes no other visible securing members, such that separate neck and body portions can be connected together while maintaining a one-piece aesthetic quality of the instrument.

23 Claims, 4 Drawing Sheets

STRINGED INSTRUMENT WITH IMPROVED NECK AND BODY ATTACHMENT

FIELD OF THE INVENTION

The present invention relates generally to stringed musical instruments and, more specifically, to an improved stringed musical instrument and method of making a stringed musical instrument, especially an electric stringed instrument (e.g., an electric guitar), having attached neck and body portions.

DESCRIPTION OF THE RELATED ART

There are numerous types of stringed instruments, e.g., guitars, banjos, etc., known in the art. Typically, guitars, for example, are constructed with two distinct portions—a wide body portion and a narrow neck portion extending therefrom. The strings of the guitar are typically mounted along the neck of the guitar, with first ends of the strings attached to the body and second ends of the strings attached at a distal end of the neck. The body can be hollow, semi-hollow or solid, as known in the art.

While neck and body portions have been formed as a single integral unit, a variety of guitars have been made in which the neck and body portions are formed from separate portions that are attached together to form the instrument. As some examples: U.S. Pat. No. 5,353,672 shows a guitar with a quick-release neck; U.S. Pat. No. 5,347,904 shows a guitar with a replaceable neck; U.S. Pat. No. 4,939,970 shows a connector for joining the neck and body of a guitar; U.S. Pat. No. 4,432,267 shows an adjustable neck-body joint for a guitar; U.S. Pat. No. 4,377,962 shows a collapsible banjo having a removable neck 11; U.S. Pat. No. 4,172,405 shows an attachment of guitar neck and body portions; U.S. Pat. No. 4,073,211 shows a collapsible guitar in which the neck is hinged to the guitar body; and U.S. Pat. No. 3,657,462 shows a stringed instrument with a detachable neck.

While a number of neck and body attachments are known in the art, there are a variety of problems with such existing attachments. Among other things, existing attachments can be difficult to assemble, costly to assemble, structurally unsound and aesthetically undesirable. Thus, there exists a continued need in the art for improved neck and body attachment methods and devices.

SUMMARY OF THE INVENTION

The present invention overcomes the above and other problems in the art. The present invention provides a neck and body attachment having substantial benefits over existing devices and structures.

According to a first general aspect of the invention, a stringed musical instrument, is provided that includes: a) a body having a front surface and a rear surface; b) a bridge mounted on the front surface; c) at least one cavity below the front surface between the bridge and one end of the body; d) a separate neck mounted to the body, the neck having a proximal end that overlaps with a portion of the body and that extends behind the at least one cavity; e) at least one securing member extending from the at least one cavity through the body and partly into the proximal end for attaching the neck to the body; f) a cover element located within the at least one cavity covering the at least one securing member; and g) front and rear surfaces of the body and neck being free of visible securing members. Preferably, the instrument is an electric instrument and the cover element is a sound pick-up.

According to a second general aspect of the invention, a method of making a stringed instrument is provided that includes the steps of: a) providing a body having a front surface, a rear surface, a bridge mounted on the front surface, and a cavity extending to the front surface between the bridge and one end of the body; b) providing a separate neck, the neck having a narrowed proximal end; c) overlapping the proximal end of the neck and the body such that the proximal end extends behind the cavity; e) connecting a plurality of securing members that extend from the cavity through the body and partly into the proximal end for attaching the neck to the body; f) placing a cover element within the cavity over said securing members; and g) forming the front and rear surfaces of the body and neck to be free of visible securing members.

The above and other objects, features and advantages of the invention will be even further understood based on the following detailed description of the invention taken in connection with the accompanying drawings and claims.

DETAILED DESCRIPTION OF PREFERRED EMBODIMENTS

Figure 1:
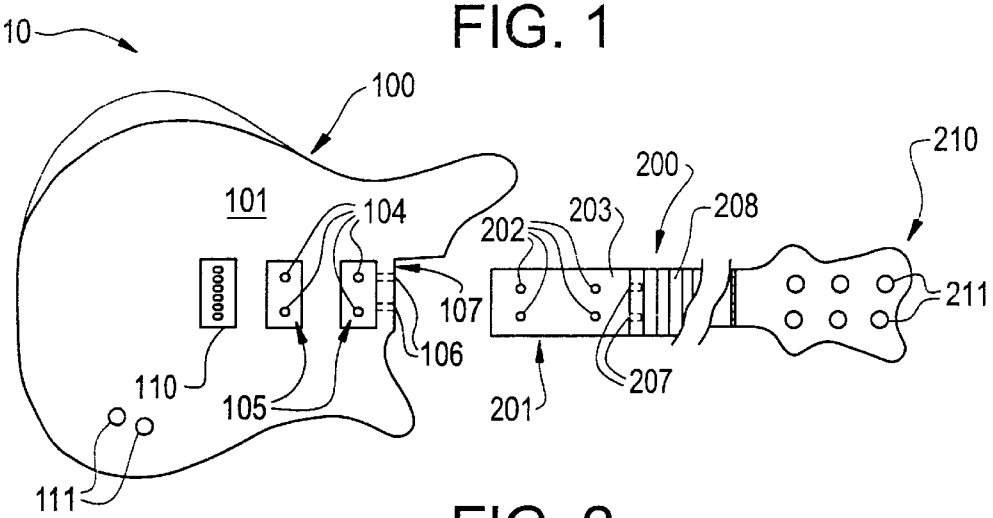
FIG. 1 shows a plan view of a first embodiment of the invention.

FIG. 1 shows a first embodiment of the invention involving a stringed instrument (e.g., an electric guitar) 10 having separate body 100 (e.g., sound-board) and neck 200 portions. In the illustrated embodiment, the body 100 is generally solid and has generally flat front and rear surfaces 101 and 102, respectively. In alternative embodiments, the body 100 can include an interior cavity and/or can be constructed with any other body configuration known in the art. While the preferred embodiments of the invention are described in connection with an electric guitar, the present invention can be applied to all types of stringed instruments having one or more neck attached to a body.

Figure 2:
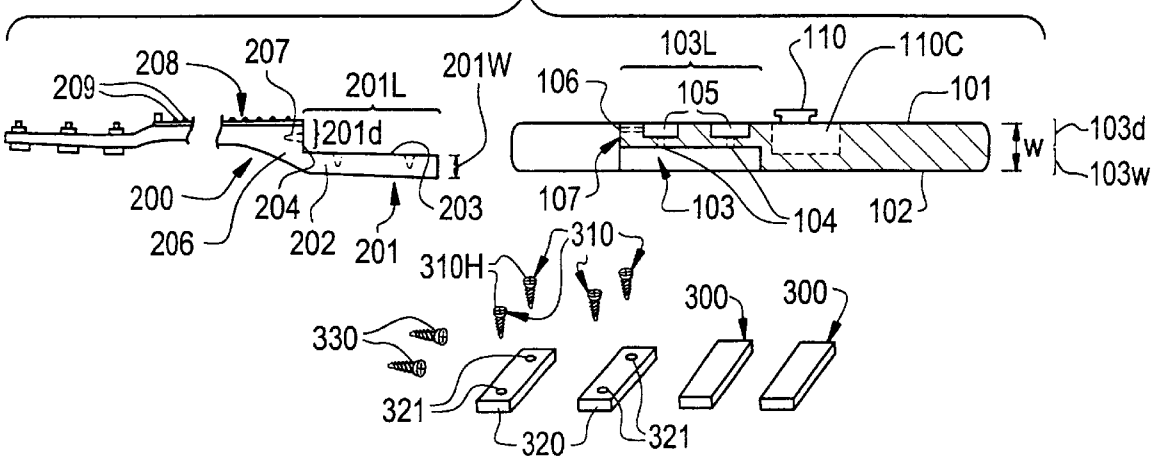
FIG. 2 shows a side elevational view of a first embodiment of the invention.

As shown in FIGS. 1 and 2, the neck 200 preferably includes a fret board 208 having a plurality of fret bars 207 (alternatively, fretless necks can be used) and a headstock 210 having connectors 211 for connecting respective strings (not shown) of the instrument, as are well known in the art. In addition, the body 100 preferably includes a bridge 110, sound pick-up devices 105 (e.g., discussed below), and control knobs 111 (e.g., volume, on-off, etc.), as are also well known in the art.

Figure 3:
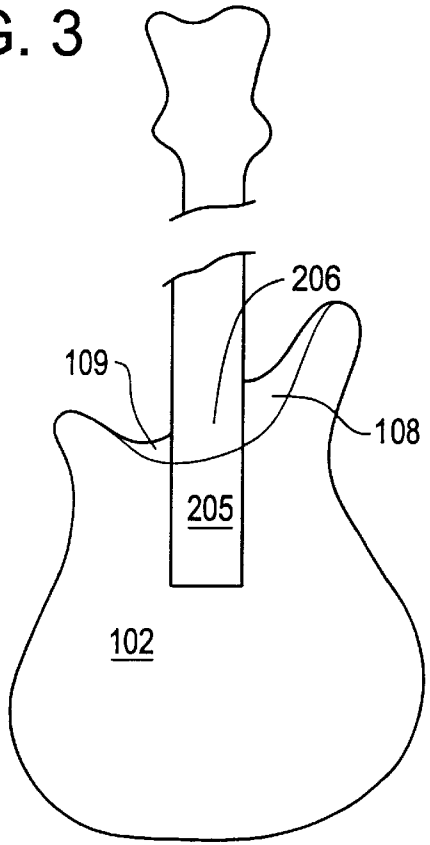

As best shown in FIG. 2, the rear surface of the body 100 preferably includes a recess 103 configured to receive a proximal end 201 of the neck 200. The proximal end 201 is preferably configured to snugly fit in the recess 103 when the neck 200 is attached to the body 100 as shown in FIG. 3. The proximal end 201 preferably includes a plurality of pre-formed (e.g., pre-drilled) holes 202 in the surface 203 that extend partly through the width 201W of the proximal end 201 in a direction generally perpendicular to the surface 203.

Figure 4:
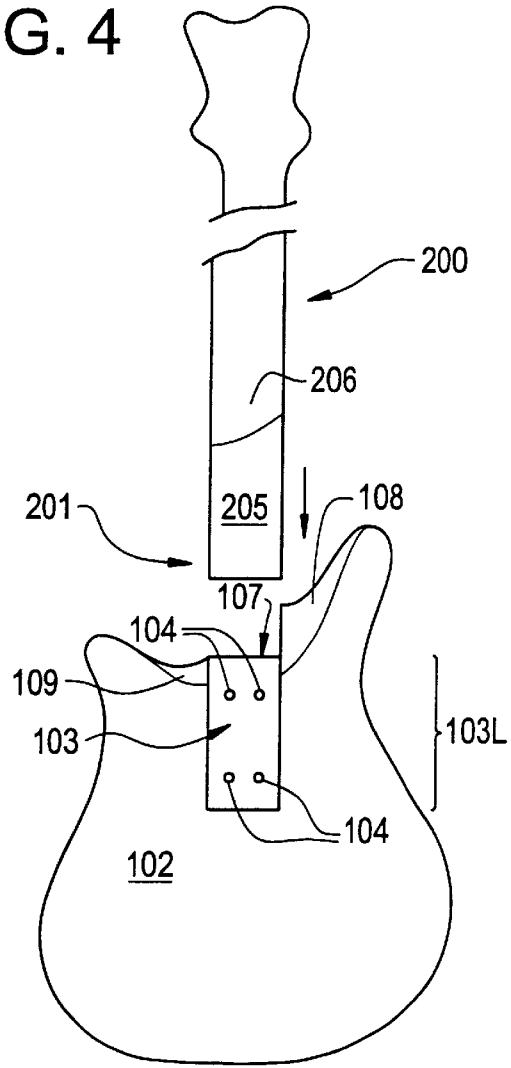
FIGS. 3 and 4 depict rear plan views of a first embodiment of the invention.

As best shown in FIGS. 2 and 4, the body 100 also preferably includes a plurality of pre-formed holes 104 that are arranged in a similar pattern to the pre-formed holes 202.

The pre-formed holes 104 preferably extend from the recess 103 to at least one cavity 105 formed below front surface 101. In the illustrated embodiment, two cavities 105 are shown, each having two corresponding pre-formed holes. It is contemplated, however, that one cavity 105 could be used in other embodiments. Alternatively, three or more cavities 105 could also be used. In addition, while four pre-formed holes are shown, other embodiments can include less pre-formed holes (as little as one) or more pre-formed holes.

Most preferably, each cavity 105 is sized to accommodate one or more sound pick-up device 300. These sound pick-up devices (a.k.a. "pick-ups") are well known in the art. Pick-ups typically sense string vibration and generate electric signals representative thereof. Pick-ups are typically located in positions on a guitar body similar to that shown in FIG. 1 (i.e., on the body beneath the strings). Usually, the instrument has between one to four pick-ups, and most often two or three pick-ups. In the most preferred embodiments, the number of pick-ups corresponds to the number of cavities 105.

The assemblage of the neck 200 to the body 100 is performed as follows. First, the proximal end 201 is placed within in the recess 103. Then, securing members 310 are secured between the holes 104 and 202. Preferably, the securing members 310 include screws or the like. In one preferred embodiment, reinforcing plates 320 are inserted into the recesses 105 prior to inserting the screws 310. The reinforcing plates 320 provide a stronger and more rigid attachment and help reduce unwanted play or movement between the neck and body. The reinforcing plates 320 and the securing members 310 are preferably formed from rigid metal or the like, while the body and neck are preferably formed from softer materials such as natural woods, polymers, composite materials, or from other appropriate materials known in the art. The reinforcing plates preferably have through-holes 321 to receive the shafts of the screws 310, while retaining the heads 310H of the screws. In this manner, the heads 310H can press against the reinforcing plates when the screws are fully inserted. After the screws are fully screwed in, pick-ups 300 are preferably placed in the cavities 105 to cover the heads 310H of the screws 310. The pick-ups 300 can be mounted within the cavities in any manner known in the art. As a result, the neck 200 and the body 100 can be firmly connected without any visible screws or attachment hardware.

In an exemplary embodiment, the securing members 310 can be screws with threads having a diameter wider than the pre-formed holes 202 (and/or 104) so that the threads firmly connect to the body when screwed thereto. Alternatively, the holes 202 (and/or 104) can include pre-formed internal threads therein to receive corresponding threads in the screws, bolts or the like 310. As another alternative, the holes 202 (and/or 104) can include inserts to facilitate attachment to the screws, bolts or the like 310 (e.g., the inserts can include internally threaded nuts that can receive the screws or the like 310). In other less preferred embodiments, the securing members 310 can include dowels or pins that are press fit, glued and/or otherwise fixed between the neck 200 and body 100. Preferably, the securing members 310 are made from a rigid, strong material such as metal or the like.

As best shown in FIG. 1, the recess 103 preferably ends prior to the bridge 110—i.e., it preferably does not extend below the bridge 110 as shown. In that manner, the neck attachment preferably does not interfere with the bridge area. Thus, options for bridge area design are not limited by the preferred construction of the present invention. As one optional example, the bridge 110 can be made with a cavity 110C thereunder for a tremolo bridge, as is known in the art.

While the embodiments discussed above include pre-formed holes 104 and 202, it is contemplated that such holes do not always need to be pre-formed in the body and/or neck. As some examples: screws can be attached without such preformed holes (e.g., pointed-tipped wood screws can be used); nails can be forced (e.g., hammered) into the materials at the appropriate locations; etc. In alternative embodiments, in addition to the securing members 310, adhesives or the like can also be used to effect an attachment between the neck and the body. In preferred embodiments, the securing members 310 are removable and no adhesives are used so that the neck 200 can be removed from the body 100, such as for transport, storage, replacement or the like.

In the most preferred embodiments, the neck 200 also includes pre-formed holes 207 formed generally parallel (e.g., lengthwise) to the length of the neck 200 in the surface 204 and the body preferably also includes pre-formed holes 106 extending from the surface 107 to the interior of an outermost recess 105. During assemblage, securing members 330 are preferably connected between the holes 105 and 207 in a manner similar to that described above with respect to the securing members 310. Although not shown, similar reinforcing plates could also be included similar to the plates 320 discussed above. It is contemplated that all of the various embodiments, constructions and alternatives in relation to the securing members 310 and their attachment, as discussed above, can be applied to the securing members 330 and their attachment. As shown, the surface 207 preferably has a height 201*d* that is substantially equal to the height 103*d* of the surface 107 of the body 100. The inclusion of the horizontal (e.g., lengthwise) securing members 330 can, among other things, greatly enhance the structural characteristics of the device. Among other benefits, the securing members 330 help prevent undesired separation of the neck and body—e.g., the surface 203 will be inhibited from sheering away from the recess 103 when forces are applied to the neck 200.

The contact area between the neck 200 and the body 100 preferably includes both horizontal and vertical components (e.g., along the lengths 201L and 201*d*, respectively, of the proximal end 201). While the surfaces 204 and 203 are preferably at generally right angles to one another, it is contemplated that the angle between these surfaces can be varied as long as they sufficiently correspond to the configuration of the body 100. In addition, although the surfaces 204 and 203 are preferably generally planar as shown, it is also contemplated that the surfaces 204 and 203 can be varied in contour as long as they sufficiently correspond to the configuration of the body 100.

In alternative embodiments, the cavities 105 can be formed at locations other than that for receiving pick-ups. In that regard, the recesses can be covered with an insert, a cover plate or another item (such as an element supporting the bridge 110 of the instrument). Nevertheless, the most preferred and most advantageous embodiments involve placement of the securing members within such pick-up cavities.

As best shown in FIG. 3, in the preferred embodiments, the neck and the body can be formed so as to have the appearance of a single unitary piece. In that regard, for example, the surface 205 of the proximal end 201 of the neck is preferably made so as to be flush (i.e., level) with the surface 102 of the body. That is, the width 201W of the proximal end 201 is preferably substantially equal to the depth 103W of the recess. (Similarly, the depth 201*d* of the surface 204 is preferably substantially equal to the depth 103*d* of the surface 107). In addition, the rear of the neck 200 also preferably includes a contoured section 206 having a curvature corresponding to similarly contoured sections 108 and/or 109 of the body 100. In that manner, the neck and body can have a continuous contour, without any visible discontinuities. This "matching" of contours that is possible with the present invention can provide a feeling of a neck through body guitar, rather than that of a typical bolt on neck. The present invention also enables the neck to bolt onto the body without a common heel portion. It is contemplated that in other less preferred embodiments, the recess 103 can be shallower or deeper so that the surface 205 is either above or below the surface 102. In much less preferred embodiments, the recess 103 can be omitted entirely and the neck can even be attached to the surface 102 of the body.

With the present invention, if desired, the neck 200 and body 100 portions can be formed of a similar material, e.g., having a similar wood finish, such that a seemingly unitary product can be formed. Alternatively, the neck and body can be made with different finishes (e.g., with different woods, stains, colors or the like) while still maintaining an appearance of continuity since visible attachment members can be omitted on the entire rear and/or front sides of the body 100 and neck 200. As a result, the present invention can enable the neck to be of a different material and/or finish than the body while still maintaining the feel of a solid (i.e., one piece) instrument.

In addition to providing a greatly improved aesthetic appearance, the present invention also enables the neck and body portions to be very firmly and advantageously connected. As noted, the present invention also enables the neck to be connected without interfering with various options of bridge design. In addition, the present invention enables the neck to be adjusted and shimmed as desired without affecting other parts of the instrument. Furthermore, because the securing members can be hidden from normal view, a larger number of securing members can be used without detracting from the appearance of the device.

In addition, the present invention can also enhance the sound quality of the instrument. In that regard, because the proximal end 201 extends along the body 100 within the recess 103 a distance behind the pick-up cavities in the preferred embodiments, the sound quality of the instrument can be improved—i.e., creating a more "alive" sound. This latter quality may be enhanced by virtue of the securing members firmly connecting the body 100 and the neck 200 at locations directly beneath the respective pick-ups in preferred embodiments.

Figure 5A:
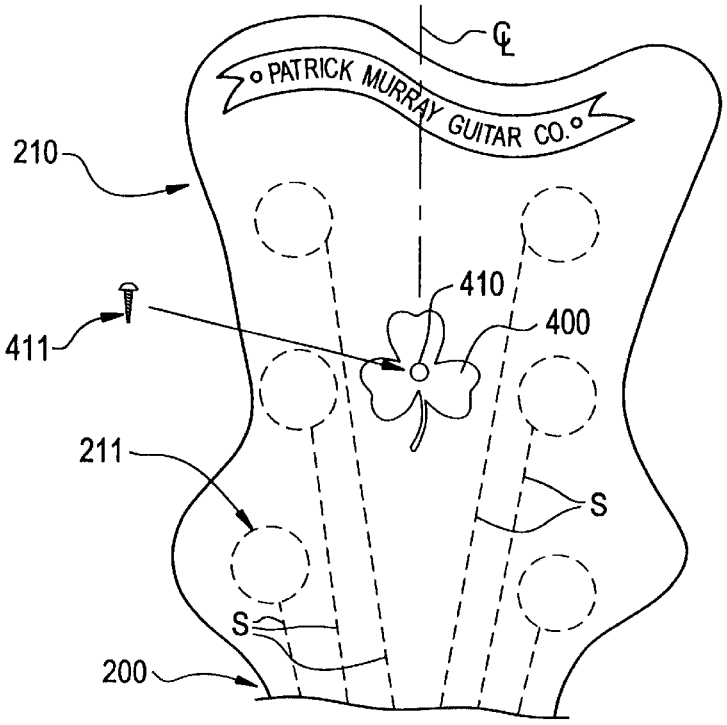
FIGS. 5(A), 5(B) and 6 illustrate optional features with respect to the invention.
Figure 5B:
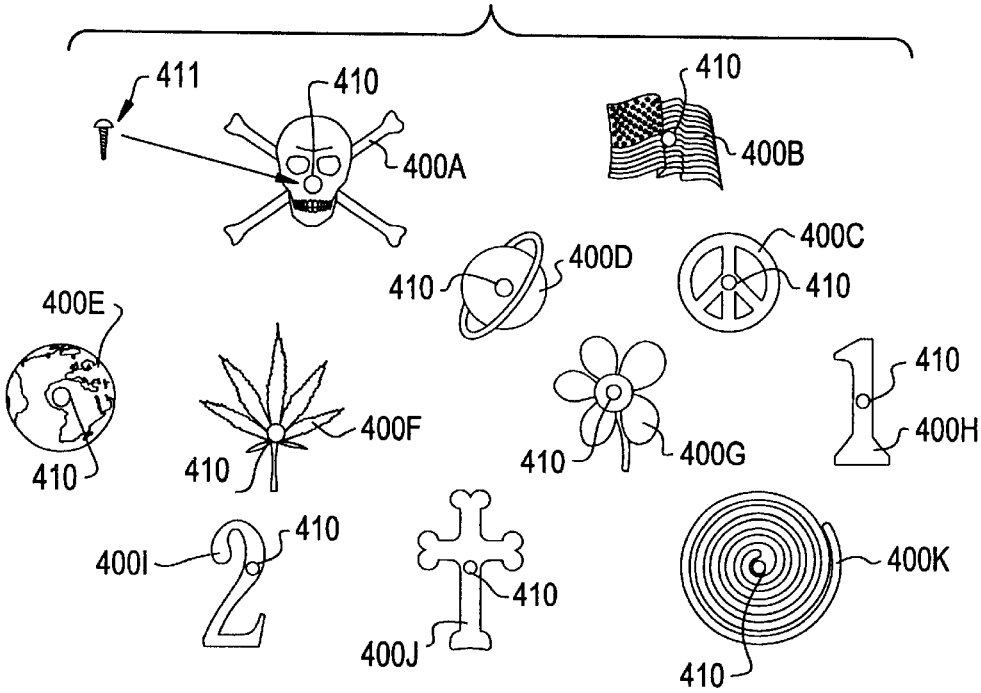
Figure 6:
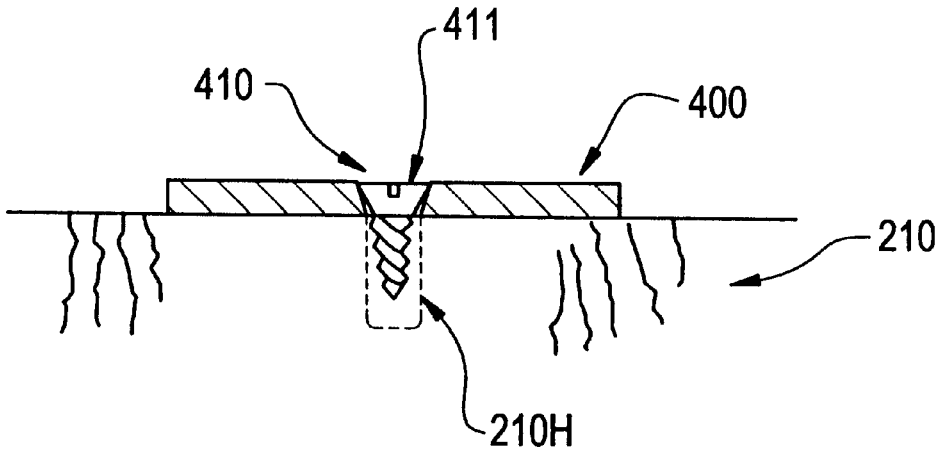

In addition to the above-described neck enhancing features, FIGS. 5(A), 5(B) and 6 illustrate optional features that can be added on the neck to further enhance the neck. While the features shown in FIGS. 5(A), 5(B) and 6 can be applied to a guitar or the like having separate neck and body portions as described herein, the features shown in FIGS. 5(A), 5(B) and 6 can be applied to any appropriate instrument.

In brief, FIG. 5(A) shows a headstock 210 having connectors 211 for respective strings S of the instrument. Although only partially shown, the headstock 210 is located at the end of an elongated neck 200 upon which the strings S are supported. As some examples, instruments can include 4 strings (e.g., banjos), 6 strings (e.g., guitars 12 strings (e.g., 12 string guitars), or any other number of strings.

As shown in FIG. 5(A), the front surface of the headstock 210 is provided with an emblem 400. The emblem 400 is preferably made of a rigid ornamental material, such as metal (e.g., bronze, silver, copper, etc.), wood, plastic, ceramic, ivory, quartz, or any other appropriate material. The emblem can also include a reflective surface, a colored surface, an illuminating surface (e.g., having glow in the dark chemistry, lighting elements (e.g., LEDs or other light sources), etc.

As shown in FIG. 6, the emblem 400 preferably includes a through-hole 410 through which a securing member 411 (e.g., such as a bolt, a screw (as shown), a rivet, a snap fit projection, etc.) is inserted to connect the emblem 400 to the front of the headstock 210. Preferably, the headstock includes a preformed hole 210H for receiving the securing member 411. The preformed hole 210H can be predrilled and can also include internal threads to threadingly engage with external threads of the securing member. In one embodiment, the preformed hole can include an annular cylindrical insert contained therein (e.g., glued or otherwise fixed therein). The insert can be of a material that is substantially stronger than the material of the headstock 210 to facilitate mounting of the emblem 400 (e.g., made of metal or the like). The insert can also include internal threads machined therein.

While the embodiment shown has the securing member 411 as a separate element, it is contemplated that the securing member 411 can be integral with the emblem 400 in alternative embodiments. For example, the securing member 411 can project from the bottom of the emblem 400, similar to that shown in FIG.6. For attachment, the entire emblem could be rotated (e.g., if the securing member has external threads), or the emblem could be pushed downward to effect engagement (e.g., if the securing member has a snap fit portion), etc.

As shown in FIG. 5(B), this latter embodiment most preferably includes an assembly having a plurality of interchangeable emblems. That is, the emblem 400 is preferably removable and replaceable such that a user can select a desired emblem at a given time. In the illustrated embodiment, an assembly of twelve emblems is shown (including emblems 400 and 400A–400K). It is contemplated that any number of interchangeable emblems could be provided. In this manner, a user can, for example, purchase a set of emblems that are packaged together (e.g., contained in one box or the like on sale) and can interchange such emblems as desired. In addition, a user can purchase additional emblems after purchase of the guitar so as to further modify the appearance as desired.

While the headstock of an instrument can be prefabricated to accommodate such emblems as described herein, it is contemplated that existing instruments can also be readily adapted to or retrofitted to incorporate such emblems. If, for example, the securing member 411 is a single wood screw, a user can readily screw such emblems to the front face of an existing instrument which does not include a preformed hole (i.e., in that case, formation of the hole 210H can be, for example, effected by the end user).

In brief, all of the emblems preferably include like attachment means so that they are each compatible with and interchangeable with one another. In one preferred embodiment, as shown, the emblems 400A–400K each include similarly sized holes 410 for accommodating the head of a screw or the like as shown in FIG. 6. As shown in FIG. 6, the holes 410 preferably have a generally conical shape such that the head of the screw or the like can be recessed at or below the upper surface of the emblem 400. Alternatively, any other appropriate attachment means can be used. In other exemplary embodiments where securing members are integrally attached to or formed on the emblems—e.g., where pins or projections are formed that extend from the bottom of the emblems (e.g., having threads thereon or snap fit elements that engage with the hole 210H)—it is contemplated that all of such securing members of the assembly of emblems should be similarly constructed so as to engage the same hole or the like formed in the headstock. While the illustrated embodiment shows a single securing member, in less preferred embodiments, it is contemplated that additional securing members could be used (e.g., 2, 3 or more screws or the like can be used).

As shown, in preferred embodiments, the emblems 400, etc., can be mounted at a location that is generally central on the face of the headstock 210. Preferably, the emblem is mounted generally along a center line CL as shown. In some preferred embodiments, the emblems 400, etc., are preferably sized and positioned, as shown, so as to not be covered by the strings S of the instrument during use. In this manner, the emblems 400, etc., can be easily interchanged and replaced without having to remove the strings S and/or without undue interference from the strings.

In some exemplary embodiments, the emblems are construct so as to be sized in proportion to the front face of the headstock approximately as shown (i.e., covering approximately a percent of the surface area of the front face as shown). It is contemplated, however, that the sizes of the emblems can vary depending on circumstances.

As a result, a user can easily apply a different emblem depending on circumstances. For example, different color emblems can be applied (e.g., to match the color of the user's clothing, to match the color of the body portion of the guitar, or for other reasons), and different shapes, etc., can be applied. FIG. 5(B) shows a few exemplary, and non-limiting, shapes that can be provided as part of an assembly—including, as shown a skull and cross-bones emblem 400A, a flag (e.g., American) emblem 400B, a planet (e.g., Saturn) emblem 400D, a peace sign emblem 400C, a globe emblem 400E, a plant (e.g., hemp) emblem 400F, a flower emblem 400G, a number emblem (e.g., 400H, 400I, etc.), a religious emblem (e.g., a cross) 400J, a spiral emblem 400K (if desired, this latter embodiment or any other embodiment can be configured so as to be free to rotate when mounted to the headstock to provide an enhanced visual effect).

While the invention has been described in detail above, the invention is not limited to the specific embodiments as described. Those skilled in the art may make numerous uses, modifications and departures from the specific embodiments described herein without departing from the inventive concepts herein.

What is claimed is:

1. A stringed musical instrument, comprising:

a) a body having a front surface and a rear surface;

b) a bridge mounted on said front surface;

c) at least one cavity below said front surface between said bridge and one end of said body;

d) a separate neck mounted to said body, said neck having a proximal end that overlaps with a portion of said body and that extends behind said at least one cavity;

e) at least one securing member extending from said at least one cavity through said body and partly into said proximal end for attaching said neck to said body;

f) a cover element located within said at least one cavity covering said at least one securing member;

g) front and rear surfaces of said body and neck being free of visible securing members; and h) wherein said instrument is an electric instrument and said cover element is a sound pick-up.

2. The instrument of claim 1, wherein said at least one cavity includes a plurality of cavities, each cavity having a respective sound pick-up therein.

3. A stringed musical instrument, comprising:

a) a body having a front surface and a rear surface;

b) a bridge mounted on said front surface;

c) at least one cavity below said front surface between said bridge and one end of said body;

d) a separate neck mounted to said body, said neck having a proximal end that overlaps with a portion of said body and that extends behind said at least one cavity;

e) at least one securing member extending from said at least one cavity thorough said body and partly into said proximal end for attaching said neck to said body;

f) a cover element located within said at least one cavity covering said at least one securing member;

g) front and rear surfaces of said body and neck being free of visible securing members; and h) wherein said body includes a recess on a rear side thereof that is sized to snugly receive said proximal end of said neck.

4. The instrument of claim 3, wherein when said neck is attached to said body, said rear surface of said neck is substantially flush with said rear surface of said body.

5. The instrument of claim 3, wherein said at least one securing member includes a plurality of securing members extending generally perpendicular to a front surface of said body and widthwise into said body.

6. The instrument of claim 5, wherein said instrument is an electric instrument and said cover element is a sound pick-up.

7. The instrument of claim 3, wherein said at least one securing member includes a plurality of securing members extending generally parallel to a front surface of said body and lengthwise into said body.

8. The instrument of claim 7, wherein said instrument is an electric instrument and said cover element is a sound pick-up.

9. The instrument of claim 3, wherein a rear side of said neck includes a contour and a rear side of said body includes a corresponding contour such that when said neck is attached to said body said contour of said neck aligns with said contour of said body.

10. The instrument of claim 9, wherein said contour of said neck is adjacent said proximal end and said contour of said body is at a perimeter of said body.

11. The instrument of claim 3, wherein said securing members have threads.

12. The instrument of claim 11, wherein said securing members are bolts or screws.

13. The instrument of claim 3, wherein each said cavity includes a reinforcing plate, and said securing members have head portions that are engageable with said reinforcing plate when attached.

14. A stringed musical instrument, comprising:

a) a body having a front surface and a rear surface;

b) a bridge mounted on said front surface;

c) at least one cavity below said front surface between said bridge and one end of said body;

d) a separate neck mounted to said body, said neck having a proximal end that overlaps with a portion of said body and that extends behind said at least one cavity;

e) at least one securing member extending from said at least one cavity through said body and partly into said proximal end for attaching said neck to said body;

f) a cover element located within said at least one cavity covering said at least one securing member;

g) front and rear surfaces of said body and neck being free of visible securing members; and h) wherein said neck has a headstock at a distal end thereof at which strings are secured, a first emblem on a front surface of said headstock, a securing member extending between said first emblem and said headstock, said securing member being removably connectable to said headstock, and at least one additional emblem separated from said headstock which is interchangeable with said first emblem on said headstock.

15. A method of constructing a stringed instrument, comprising the steps of:

a) providing a body having a front surface, a rear surface, a bridge mounted on said front surface, and a cavity extending to said front surface between said bridge and one end of said body;

b) providing a separate neck, said neck having a narrowed proximal end;

c) overlapping said proximal end of said neck and said body such that the proximal end extends behind said cavity;

e) connecting a plurality of securing members that extend from said cavity through said body and partly into said proximal end for attaching said neck to said body;

f) placing a cover element within said cavity over said securing members;

g) forming the front and rear surfaces of said body and neck to be free of visible securing members; and h) providing said instrument as an electric instrument and providing said cover element from a sound pick-up of said instrument.

16. The method of claim 15, further including:

a) providing said neck with a headstock at a distal end thereof at which strings are secured;

b) removably attaching a first emblem on a front surface of said headstock with a securing member that extends between said emblem and said headstock; and c) providing at least one additional emblem separate from said headstock which is interchangeable with said first emblem on said headstock.

17. The method of claim 16, further including the steps of removing said first emblem from said headstock and attaching one of said at least one additional emblem in place of said first emblem.

18. A method of constructing a stringed instrument, comprising the steps of:

a) providing a body portion having a bridge mounted on a front surface of said body portion;

b) providing an elongated neck extending from said body portion;

c) providing said neck with a headstock at a distal end thereof at which strings are secured;

d) removably attaching an emblem on a front surface of said headstock with a securing member that extends between said emblem and said headstock;

e) providing at least one additional emblem separate from said headstock which is interchangeable with said first emblem on said headstock; and f) removing said first emblem from said headstock and attaching one of said at least one additional emblem in place of said first emblem.

19. The method of claim 18, further including:

a) providing said body portion and said neck portion from separate members;

b) providing said body portion with a cavity extending to said front surface between said bridge and one end of said body;

c) overlapping a proximal end of said neck and said body such that the proximal end extends behind said cavity;

d) connecting a plurality of securing members that extend from said cavity through said body and partly into said proximal end for attaching said neck to said body;

e) placing a cover element within said cavity over said securing members; and f) forming the front and rear surfaces of said body and neck to be free of visible securing members.

20. The method of 19, further including providing said instrument as an electric instrument and providing said cover element from a sound pick-up of said instrument.

21. The method of claim 18, wherein said step of removably attaching an emblem on a front surface of said headstock with a securing member that extends between said emblem and said headstock includes providing said securing member with external threads that are engaged with said headstock.

22. The method of claim 18, wherein said step of removably attaching an emblem on a front surface of said headstock with a securing member that extends between said emblem and said headstock includes providing said securing member as a screw and providing each of said emblems with a through-hole which receives said screw.

23. The method of claim 18, wherein said step of removably attaching an emblem on a front surface of said headstock with a securing member that extends between said emblem and said headstock includes providing said securing member as a projection having means for engaging within a hole formed in said headstock.

* * * * *